US009353506B2

(12) United States Patent
Si

(10) Patent No.: US 9,353,506 B2
(45) Date of Patent: May 31, 2016

(54) INSTALLATION STRUCTURE FOR A WATER INLET PIPE

(71) Applicant: Beijing Kohler Ltd., Beijing (CN)

(72) Inventor: He Si, Beijing (CN)

(73) Assignee: BEIJING KOHLER LTD. (CN)

( * ) Notice: Subject to any disclaimer, the term of this patent is extended or adjusted under 35 U.S.C. 154(b) by 157 days.

(21) Appl. No.: 13/791,683

(22) Filed: Mar. 8, 2013

(65) Prior Publication Data

US 2013/0248003 A1 Sep. 26, 2013

(30) Foreign Application Priority Data

Mar. 21, 2012 (CN) ..... 2012 2 0110106

(51) Int. Cl.

| | |
|---|---|
| ***F16L 39/00*** | (2006.01) |
| ***E03B 1/04*** | (2006.01) |
| ***E03B 3/00*** | (2006.01) |
| ***E03C 1/04*** | (2006.01) |

(52) U.S. Cl.

CPC ... *E03B 1/04* (2013.01); *E03B 3/00* (2013.01); *E03C 1/0403* (2013.01); *Y10T 137/0402* (2015.04); *Y10T 137/87571* (2015.04)

(58) Field of Classification Search

CPC ..... F16L 39/00; F16L 41/001; F16L 41/08

USPC ..... 285/124.2, 124.3, 124.4, 124.1

See application file for complete search history.

(56) References Cited

U.S. PATENT DOCUMENTS

| | | | | |
|---|---|---|---|---|
| 3,135,535 | A * | 6/1964 | Shepard | 285/124.2 |
| 3,162,412 | A * | 12/1964 | McEntire | 285/124.2 |
| 3,394,761 | A * | 7/1968 | Jackson et al. | 285/124.2 |
| 3,503,634 | A * | 3/1970 | Cadiou | 285/124.3 |
| 3,948,315 | A * | 4/1976 | Powell | 285/124.2 |
| 4,345,786 | A * | 8/1982 | Egert | 285/124.4 |
| 4,612,980 | A * | 9/1986 | Roberts | 285/124.1 |
| 4,834,825 | A * | 5/1989 | Adams et al. | 285/124.2 |
| 5,078,432 | A * | 1/1992 | Seiter | 285/124.3 |
| 6,076,863 | A * | 6/2000 | Platt Brown et al. | 285/124.1 |
| 6,450,552 | B1 * | 9/2002 | Pulmanns et al. | 285/124.3 |
| 6,669,238 | B1 * | 12/2003 | Santy, Jr. | 285/124.4 |
| 7,014,222 | B1 * | 3/2006 | Poppe | 285/124.3 |
| 7,625,015 | B2 * | 12/2009 | Spiegelman et al. | 285/124.3 |
| 8,136,844 | B1 * | 3/2012 | Liu | 285/124.3 |

(Continued)

FOREIGN PATENT DOCUMENTS

| | | |
|---|---|---|
| CN | 2632570 | 8/2004 |
| CN | 2751256 | 1/2006 |

(Continued)

*Primary Examiner* — David E Bochna

(74) *Attorney, Agent, or Firm* — Foley & Lardner, LLP

(57) ABSTRACT

An installation structure for a water inlet pipe includes a first water inlet pipe and a second water inlet pipe disposed adjacent one another, a water inlet base with a first water inlet hole configured to receive the first water inlet pipe, and a second water inlet hole configured to receive the second water inlet pipe, a shell substantially surrounding the first water inlet pipe and the second water inlet pipe, and having a first end configured to engage the water inlet base, and a limiting device formed from a resilient material and disposed within the shell, the limiting device having a first limiting groove that receives the first water inlet pipe and a second limiting groove that receives the second water inlet pipe for limiting displacement of the first water inlet pipe and the second water inlet pipe within the shell.

19 Claims, 3 Drawing Sheets

(56) References Cited

U.S. PATENT DOCUMENTS

| | | | | |
|---|---|---|---|---|
| 2002/0163187 | A1* | 11/2002 | Pelfrey et al. | 285/124.1 |
| 2007/0186339 | A1 | 8/2007 | Mattson et al. | |

FOREIGN PATENT DOCUMENTS

| | | |
|---|---|---|
| CN | 2903877 | 5/2007 |
| CN | 201000105 | 1/2008 |
| CN | 201762791 | 3/2011 |
| CN | 202126718 | 1/2012 |
| CN | 202158681 | 3/2012 |
| CN | 202370736 | 8/2012 |
| CN | 202830561 | 3/2013 |

* cited by examiner

INSTALLATION STRUCTURE FOR A WATER INLET PIPE

CROSS-REFERENCE TO RELATED PATENT APPLICATIONS

This application claims priority to China P.R. Application No. 201220110106.3, filed Mar. 21, 2012 including the specification, drawings, claims and abstract, and is incorporated herein by reference in its entirety.

FIELD

The present disclosure relates to the water supply field and in particular to an installation structure of a water inlet pipe. More particularly, the present disclosure relates to an installation structure of a water inlet pipe that may be used for a bathtub water supply.

BACKGROUND

Faucets are a common water supply device in daily life. Typically, a faucet has two water inlet pipes with one water inlet pipe for hot water and the other water inlet pipe for cold water. Typically, the two water inlet pipes are not in contact with each other. In use, a user may adjust the ratio of cold water to hot water in the water flowing out of the faucet as needed, thereby adjusting the temperature of the water from the faucet.

The generally known faucets usually require a water inlet base that needs to be first installed at a proper position while installing top-assembly faucets (e.g. for floor bathtubs, etc.), then the two water inlet pipes of the faucet can be tightly connected with two water inlet holes on the water inlet base to meet the water use demand of users. Since the two water inlet pipes in a faucet are usually encompassed in an opaque shell, it is difficult for an installer to directly see the water inlet pipes during installation, typically requiring the installer to insert the water inlet pipes into the corresponding water inlet holes by feeling, making the installation difficult; moreover, the water inlet pipes are usually made of copper that is relatively soft, which tends to deform during the installation, making it more difficult to insert the water inlet pipes into the corresponding water inlet holes and consequently making it more difficult for installation.

SUMMARY

One embodiment of the present disclosure provides an installation structure for a water inlet pipe, which is intended to simplify the installation of top-assembly faucets with two water inlet pipes. The water inlet pipe includes a first water inlet pipe and a second water inlet pipe, and the installation structure for the water inlet pipe includes a water inlet base with a first water inlet hole and a second water inlet hole, the first water inlet pipe being connected with the first water inlet hole of the water inlet base, the second water inlet pipe being connected with the second water inlet hole of the water inlet base, and a limiting device disposed between the first water inlet pipe and the second water inlet pipe for limiting the first water inlet pipe and the second water inlet pipe together with a shell. The shell encompasses the first water inlet pipe and the second water inlet pipe and is disposed with a first limiting groove for limiting the first water inlet pipe and a second limiting groove for limiting the second water inlet pipe.

According to another embodiment, sealing members are provided in the form of paper gaskets or rubber seal rings, and the first water inlet pipe and said second water inlet pipe are made of copper, and the limiting device is made of a resilient material which may comprise a rubber material.

According to another embodiment, the installation structure for the water inlet pipe includes a limiting device disposed between the first water inlet pipe and the second water inlet pipe, the limiting device may act together with a shell that encompasses the first water inlet pipe and the second water inlet pipe to keep a center distance between the first water inlet pipe and the second water inlet pipe equal to a center distance between a first water inlet hole and a second water hole on the water inlet base, such that the first water inlet pipe and the second water inlet pipe are not easily deformable during installation, which simplifies the installation.

According to another embodiment, an installation structure for a water inlet pipe includes a first water inlet pipe and a second water inlet pipe disposed adjacent one another, a water inlet base with a first water inlet hole configured to receive the first water inlet pipe, and a second water inlet hole configured to receive the second water inlet pipe, a shell substantially surrounding the first water inlet pipe and the second water inlet pipe, and having a first end configured to engage the water inlet base, and a limiting device formed from a resilient material and disposed within the shell, the limiting device having a first limiting groove that receives the first water inlet pipe and a second limiting groove that receives the second water inlet pipe for limiting displacement of the first water inlet pipe and the second water inlet pipe within the shell.

According to a further embodiment, an installation structure for a water inlet pipe includes a first water inlet pipe and a second water inlet pipe, a water inlet base with a first water inlet hole and a second water inlet hole, the first water inlet pipe being connected with the first water inlet hole of the water inlet base, the second water inlet pipe being connected with the second water inlet hole of the water inlet base, a shell encompassing the first water inlet pipe and the second water inlet pipe; and a limiting device disposed between the first water inlet pipe and the second water inlet pipe for limiting the first water inlet pipe and the second water inlet pipe together within the shell.

According to yet another embodiment, a method of assembling an installation structure for a water inlet pipe includes inserting a limiting device between a first water inlet pipe and a second water inlet pipe and inside a shell, and connecting the shell with a water inlet base, so that the first water inlet pipe is coupled to a first water inlet hole and the second water inlet pipe is coupled to a second water inlet hole.

According to a further embodiment, a method of providing an installation structure for a water inlet pipe includes providing a first water inlet pipe and a second water inlet pipe disposed adjacent one another, providing a water inlet base with a first water inlet hole configured to receive the first water inlet pipe and a second water inlet hole configured to receive the second water inlet pipe, providing a shell substantially surrounding the first water inlet pipe and the second water inlet pipe and having a first end configured to engage the water inlet base, and providing a limiting device formed from a resilient material and disposed within the shell, the limiting device having a first limiting groove that receives the first water inlet pipe and a second limiting groove that receives the second water inlet pipe to limit displacement of the first water inlet pipe and the second water inlet pipe within the shell.

BRIEF DESCRIPTION OF THE DRAWINGS

To further clearly describe embodiments of the present disclosure, the drawings to be used to describe the embodiments will be briefly described. It is apparent that the drawings described below are only some embodiments of the present disclosure. Those skilled in the art may obtain other drawings according to these drawings without making innovative effort.

DETAILED DESCRIPTION

Figure 1:
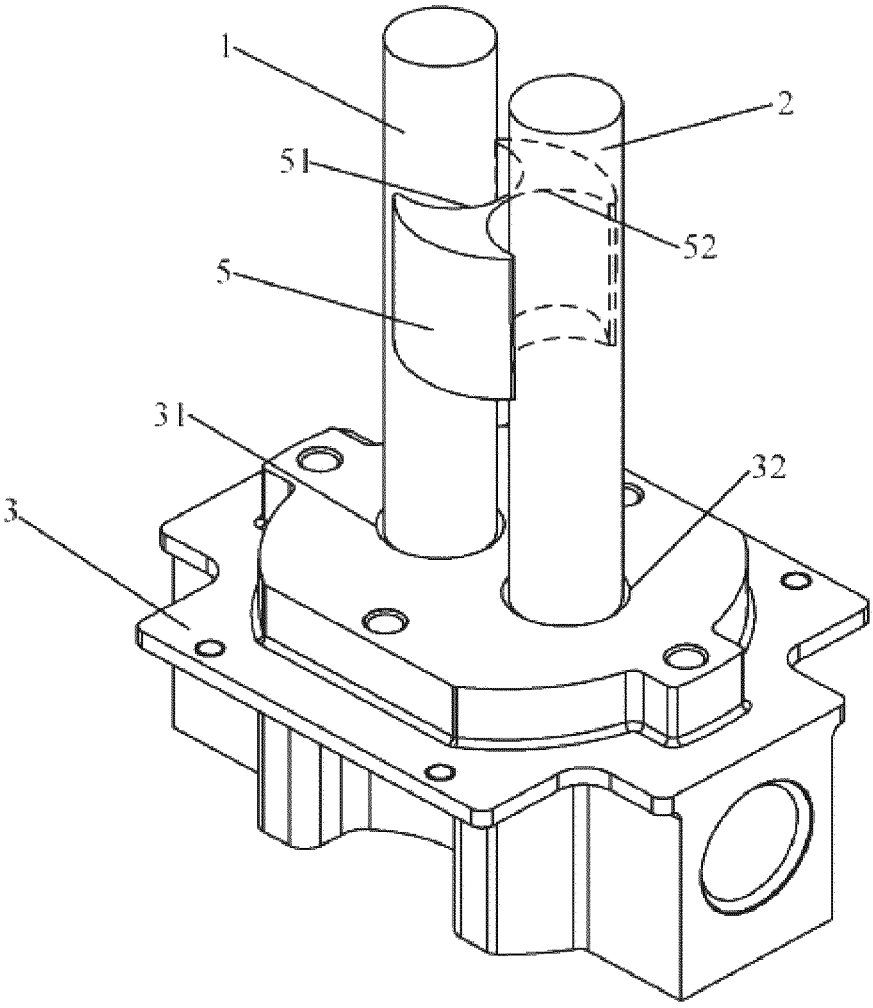
FIG. 1 illustrates a front perspective view of an installation structure for a water inlet pipe according to an exemplary embodiment.
Figure 2:
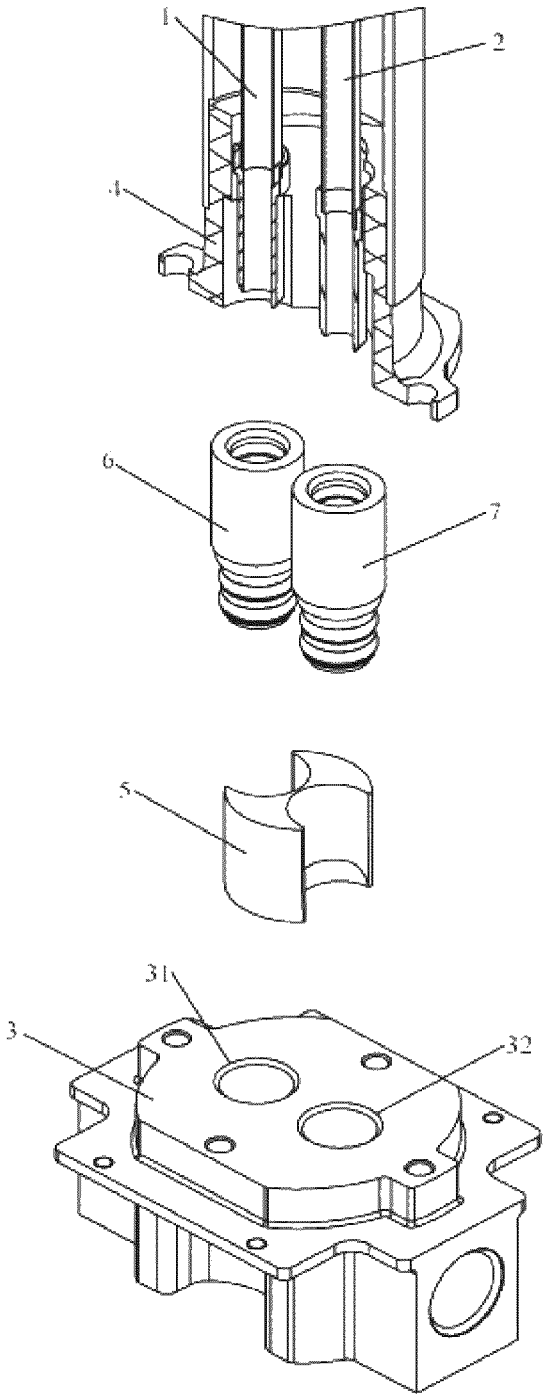
FIG. 2 illustrates an exploded front perspective view of the disassembled installation structure for a water inlet pipe according to the embodiment of FIG. 1.

Referring to FIGS. 1-2, embodiments of the present disclosure provide an installation structure for a water inlet pipe, the water inlet pipe comprising a first water inlet pipe 1 and a second water inlet pipe 2, the installation structure for the water inlet pipe comprising a water inlet base 3 with a first water inlet hole 31 and a second water inlet hole 32, the first water inlet pipe 1 being connected with the first water inlet hole 31 of the water inlet base 3, the second water inlet pipe 2 being connected with the second water inlet hole 32 of the water inlet base 3.

According to one embodiment, both the first water inlet pipe 1 and the second water inlet pipe 2 are made of copper. Copper has a relatively low hardness and good ductility. As a result, the first water inlet pipe 1 and the second water inlet pipe 2 made of copper are relatively easy to deform.

During installation, the first water inlet pipe 1 and the second water inlet pipe 2 are usually encompassed in a common opaque shell 4 that engages with the edge of the water inlet base 3. When the shell 4 is connected with the water inlet base 3, the first water inlet pipe 1 is inserted into the first water inlet hole 31 and the second water inlet pipe 2 is inserted into the second water inlet hole 32. Since both the first water inlet pipe 1 and the second water inlet pipe 2 are easy to deform, as well as due to the shielding by the shell 4, an installer can usually only determine whether the water inlet pipes are tightly connected with the water inlet holes by feeling. It may even be difficult to determine whether the water inlet pipes have been inserted into the corresponding water inlet holes, leading to difficulty in installation.

As shown in FIG. 1, therefore, the installation structure for a water inlet pipe in the embodiment of the present utility model further includes a limiting device 5 disposed between the first water inlet pipe 1 and the second water inlet pipe 1 for limiting the first water inlet pipe 1 and the second water inlet pipe 2 together with the shell 4;

The limiting device 5 has been disposed between the first water inlet pipe 1 and the second water inlet pipe 2 inside the shell 4 before the installation of the water inlet pipes with the corresponding water inlet holes, the limiting device 5 limits the first water inlet pipe 1 and the second water inlet pipe 2 between the limiting device 5 and the shell, such that the center distance between the first water inlet pipe 1 and the second water inlet pipe 2 is substantially equal to the center distance between the first water inlet hole 31 and the second water hole 32, and moreover, the limiting device 5 is typically disposed at a position not far from the ends of the first water inlet pipe 1 and the second water inlet pipe 2, the cooperation between the limiting device 5 and the shell 4 is intended to ensure that the first water inlet pipe 1 and the second water inlet pipe 2 are not easy to deform during installation and are easier to form a tight engagement with the corresponding water inlet holes, which is intended to simplify the installation.

To achieve a better match between the limiting device 5 and the shell 4, the limiting device 5 may be disposed with a first limiting groove 51 for limiting the first water inlet pipe 1 and a second limiting groove 52 for limiting the second water inlet pipe 2. Wherein the inner surface of the first limiting groove 51 closely contacts the external sidewall of said first water inlet pipe 1 and similarly, the inner surface of the second limiting groove 52 closely contacts the external sidewall of said second water inlet pipe 52.

Referring further to FIG. 2, during assembly, the limiting device 5 is inserted between the first water inlet pipe 1 and the second water inlet pipe 2 from one end of the shell 4. To facilitate the assembly of the limiting device 5, the edge of the end of the limiting device 5 that first enters the shell 4 may have a relatively small thickness (such as a leading edge taper, chamfer or the like).

According to one embodiment, the limiting device 5 may be made of rubber. Since rubber is generally known to have good flexibility, the limiting device 5 can act as a protective device for the first water inlet pipe 1 and the second water inlet pipe 2 during installation, which makes it less likely for the first water inlet pipe 1 and the second water inlet pipe 2 to be damaged due to deformation during installation.

Referring further to FIG. 2, the installation structure of water inlet pipe may further include a first water inlet pipe connector 6 for connecting the first water inlet pipe 1 with the first water inlet hole 31, and a second water inlet pipe connector 7 for connecting the second water inlet pipe 2 with the second water inlet hole 32. According to an exemplary embodiment, sealing members are disposed on the first water inlet pipe connector 6 and said second water inlet pipe connector 7. More particularly, the sealing members of the first water inlet pipe connector 6 may be disposed on the inner sidewall of one end and the external sidewall of the other end for sealed connection with the first water inlet pipe 1 and the first water inlet hole, respectively. The sealing members of the second water inlet pipe connector 7 are similar to the sealing members of the first water inlet pipe connector 6. According to one embodiment, the sealing members may be paper gaskets or rubber seal rings.

Figure 3:
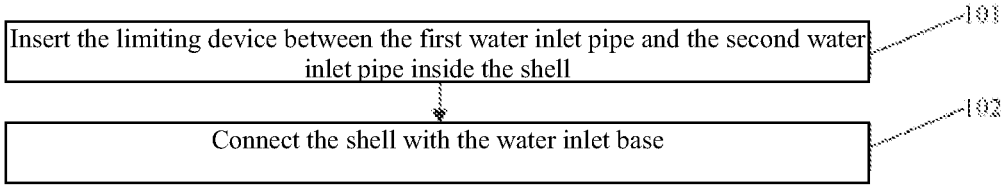
FIG. 3 illustrates a flow chart describing an installation method for the installation structure for a water inlet pipe according to an exemplary embodiment.

Referring now to FIG. 3, a process to assemble the installation structure for a water inlet pipe in shown according to an exemplary embodiment to include the following steps:

Step 101. Insert the limiting device 5 between the first water inlet pipe 1 and the second water inlet pipe 2 inside the shell 4.

Step 102. Connect the shell 4 with the water inlet base 3. At this point, the first water inlet pipe 1 is connected with the first water inlet hole 31 and the second water inlet pipe 2 is connected with the second water inlet hole 32.

Figure 4:
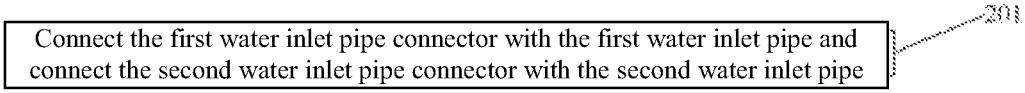
FIG. 4 illustrates a flow chart describing a further installation method for the installation structure for a water inlet pipe according to the embodiment of FIG. 3.

Referring now to FIG. 4, when the first water inlet pipe connector 6 and the second water inlet pipe connector 7 are present, before Step 101, the method further comprises the following steps.

Step 201. Connect the first water inlet pipe connector 6 with the first water inlet pipe 1 and connect the second water inlet pipe connector 7 with the second water inlet pipe 2. To couple the shell 4 and the water inlet base 3, screw holes may be formed on a plurality of corresponding positions on the shell 4 and the water inlet base 3.

According to any exemplary embodiment of the present disclosure, the installation structure for a water inlet pipe comprises a limiting device disposed between the first water inlet pipe and the second water inlet pipe, the limiting device may act together with a shell that encompasses the first water inlet pipe and the second water inlet pipe to keep the center distance between the first water inlet pipe and the second water inlet pipe equal to the center distance between the first water inlet hole and the second water hole on the water inlet base, such that the first water inlet pipe and the second water inlet pipe are not easy to deform during installation, which simplifies the installation.

As utilized herein, the terms "approximately," "about," "substantially," "essentially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the Figs. It should be noted that the orientation of various elements may differ according to other exemplary embodiments, and that such variations are intended to be encompassed by the present disclosure.

It is important to note that the construction and arrangement of the installation structure for a water pipe as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, manufacturing processes, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. An installation structure for a water inlet pipe, comprising:

a first water inlet pipe and a second water inlet pipe for transferring water therethrough, a water inlet base with a first water inlet hole and a second water inlet hole, the first water inlet pipe being connected with the first water inlet hole of the water inlet base, the second water inlet pipe being connected with the second water inlet hole of the water inlet base, a shell encompassing the first water inlet pipe and the second water inlet pipe, and secured to the water inlet base by a flanged connection;

a limiting device disposed between the first water inlet pipe and the second water inlet pipe for limiting deformation of the first and second water inlet pipes during installation of the first and second water inlet pipes together within the shell, the limiting device comprising a first limiting groove for limiting deformation of the first water inlet pipe and a second limiting groove for limiting deformation of the second water inlet pipe;

a first water inlet pipe connector for connecting the first water inlet pipe with the first water inlet hole; and a second water inlet pipe connector for connecting the second water inlet pipe with the second water inlet hole;

wherein an inner surface of each of the first and second water inlet pipe connectors includes a first groove disposed therein at a first end thereof; and wherein an outer surface of each of each of the first and second water inlet pipe connectors includes a second groove disposed therein at a second end thereof opposite the first end.

2. The installation structure for a water inlet pipe as set forth in claim 1, wherein the first and second limiting grooves are provided within an outer surface of the limiting device.

3. The installation structure for a water inlet pipe as set forth in claim 1, wherein sealing members are disposed within the groove of each of the first water inlet pipe connector and the second water inlet pipe connector.

4. The installation structure for a water inlet pipe as set forth in claim 3, wherein the sealing members comprise paper gaskets or rubber seal rings.

5. The installation structure for a water inlet pipe as set forth in claim 1, wherein the first water inlet pipe and the second water inlet pipe are made from a material comprising copper.

6. The installation structure for a water inlet pipe as set forth in claim 1, wherein the limiting device is made from a material comprising rubber.

7. An installation structure for a water inlet pipe, comprising:

a first water inlet pipe and a second water inlet pipe disposed adjacent one another, a water inlet base with a first water inlet hole configured to receive the first water inlet pipe, and a second water inlet hole configured to receive the second water inlet pipe, a shell substantially surrounding the first water inlet pipe and the second water inlet pipe, and having a first end configured to engage the water inlet base;

a limiting device formed from a resilient material and disposed within the shell, the limiting device comprising a first limiting groove configured to receive the first water inlet pipe and a second limiting groove for receiving the second water inlet pipe;

a first water inlet pipe connector coupled to the first water inlet pipe; and a second water inlet pipe connector coupled to the second water inlet pipe;

wherein an inner surface of each of the first and second water inlet pipe connectors includes a first groove disposed therein at a first end thereof;

wherein an outer surface of each of each of the first and second water inlet pipe connectors includes a second groove disposed therein at a second end thereof opposite the first end; and wherein the limiting device limits displacement of the first water inlet pipe and the second water inlet pipe during installation within the shell.

8. The installation structure for a water inlet pipe as set forth in claim 7, wherein an inner surface of the first limiting groove closely contacts a portion of an external sidewall of the first water inlet pipe and an inner surface of the second limiting groove closely contacts a portion of an external sidewall of the second water inlet pipe.

9. The installation structure for a water inlet pipe as set forth in claim 7, wherein an outer surface of the limiting device closely contacts an inner surface of the shell.

10. The installation structure for a water inlet pipe as set forth in claim 7, wherein sealing members are disposed within the groove of each of the first water inlet pipe connector and the second water inlet pipe connector.

11. The installation structure for a water inlet pipe as set forth in claim 10, wherein the sealing members comprise gaskets made from a paper material or seal rings made from a rubber material.

12. The installation structure for a water inlet pipe as set forth in claim 7, wherein the first water inlet pipe and the second water inlet pipe are made from a material comprising copper.

13. The installation structure for a water inlet pipe as set forth in claim 7, wherein the limiting device is made from a material comprising rubber.

14. The installation structure for a water inlet pipe as set forth in claim 7, wherein the first end of the shell is secured to the water base with one or more connectors.

15. The installation structure for a water inlet pipe as set forth in claim 7, wherein the limiting device is configured to maintain a substantially constant center distance between the first water inlet pipe and the second water inlet pipe.

16. A method of assembling an installation structure for a water inlet pipe, comprising:

inserting a limiting device between a first water inlet pipe and a second water inlet pipe and inside a shell, the limiting device comprising a first limiting groove for limiting deformation of the first water inlet pipe and a second limiting groove for limiting deformation of the second water inlet pipe;

coupling a first water inlet pipe connector having an inner groove disposed on an inner surface thereof and an outer groove disposed on an outer surface thereof to the first water inlet pipe and coupling a second water inlet pipe connector having an inner groove disposed on an inner surface thereof and an outer groove disposed on an outer surface thereof to the second water inlet pipe; and connecting the shell with a water inlet base at a flanged interface, so that the first water inlet pipe is coupled to a first water inlet hole and the second water inlet pipe is coupled to a second water inlet hole;

wherein the first and second water inlet pipes are for transferring water therethrough;

wherein the inner groove is disposed at a first end of each of the first and second water inlet pipe connectors; and wherein the outer groove is disposed at a second end opposite the first end of each of the first and second water inlet pipe connectors.

17. The method as set forth in claim 16, further comprising coupling the shell to the water inlet base.

18. A method of providing an installation structure for a water inlet pipe, comprising:

providing a first water inlet pipe and a second water inlet pipe disposed adjacent one another;

providing a first water inlet pipe connector configured to form a watertight seal between an outer surface of the first water inlet pipe and providing a second water inlet pipe connector configured to form a watertight seal between an outer surface of the second water inlet pipe, wherein a first groove is disposed within an inner surface of each of the first water inlet pipe connector and the second water inlet pipe connector, and wherein a second groove is disposed within an outer surface of each of the first water inlet pipe connector and the second water inlet pipe connector;

providing a water inlet base with a first water inlet hole configured to receive the first water inlet pipe, and a second water inlet hole configured to receive the second water inlet pipe;

providing a shell substantially surrounding the first water inlet pipe and the second water inlet pipe, and having a first end configured to engage and couple to the water inlet base; and providing a limiting device formed from a resilient material and disposed within the shell, the limiting device comprising a first limiting groove configured to receive the first water inlet pipe and a second limiting groove for receiving the second water inlet pipe for limiting displacement of the first water inlet pipe and the second water inlet pipe within the shell;

wherein the first groove is located at a first end of each of the first and second water inlet pipe connectors; and wherein the second groove is located at a second end opposite the first end of each of the first and second water inlet pipe connectors.

19. The method as set forth in claim 18, further comprising coupling the shell to the water inlet base.

* * * * *